US009434153B2

(12) United States Patent
Waizenegger et al.

(10) Patent No.: US 9,434,153 B2
(45) Date of Patent: Sep. 6, 2016

(54) NUMBERING MACHINE

(75) Inventors: Dietmar Waizenegger, Muehlheim-Stetten (DE); Josef Anton Waizenegger, Muehlheim-Stetten (DE)

(73) Assignees: PAUL LEIBINGER GMBH & CO. KG, Tuttlingen (DE); Nummerier-und Markierungssysteme, Tuttlingen (DE)

( * ) Notice: Subject to any disclaimer, the term of this patent is extended or adjusted under 35 U.S.C. 154(b) by 535 days.

(21) Appl. No.: 13/979,464

(22) PCT Filed: Dec. 27, 2011

(86) PCT No.: PCT/EP2011/006583
§ 371 (c)(1),
(2), (4) Date: Jul. 12, 2013

(87) PCT Pub. No.: WO2012/097859
PCT Pub. Date: Jul. 26, 2012

(65) Prior Publication Data

US 2013/0289771 A1 Oct. 31, 2013

(30) Foreign Application Priority Data

Jan. 18, 2011 (DE) ..... 10 2011 008 859

(51) Int. Cl.
*B41K 3/12* (2006.01)
*B41F 33/00* (2006.01)
*B41F 13/00* (2006.01)
*B41K 3/10* (2006.01)

(52) U.S. Cl.
CPC ..... *B41F 33/009* (2013.01); *B41F 13/0032* (2013.01); *B41K 3/102* (2013.01); *B41K 3/126* (2013.01); *Y10T 74/19126* (2015.01)

(58) Field of Classification Search
CPC ..... B41F 33/009
USPC ..... 101/77
See application file for complete search history.

(56) References Cited

U.S. PATENT DOCUMENTS 4,367,676 A * 1/1983 Clark ..... G07B 17/00508 101/109
4,485,735 A 12/1984 Jonca
4,628,812 A * 12/1986 Fisk ..... B41L 19/00 101/109
4,858,525 A * 8/1989 Hubbard ..... G07B 17/00508 101/110

(Continued)

FOREIGN PATENT DOCUMENTS

EP 0 090 706 A1 10/1983
EP 0 286 317 A1 10/1988

(Continued)

*Primary Examiner* — Anthony Nguyen
(74) *Attorney, Agent, or Firm* — McGlew and Tuttle, P.C.

(57) ABSTRACT

A numbering machine (100, 200) includes a housing (101, 201) and a wheel axle (107), arranged in a removable manner in the housing (101, 201), with a plurality of number wheels (108), which can each be moved individually and are arranged in for rotation. The number wheels (108) can be driven by a gearwheel (114). A drive shaft (111, 112), with a drive pinion (113), is connected to the drive shaft (111, 112) for each number wheel (108) which can be driven by means of a gearwheel (114). A displaceable drive shaft (112) can be transferred from an operating position, in which the number wheel (108) is driven by a gearwheel (114) by the displaceable drive shaft (112), to a removal position, in which the displaceable drive shaft (112) releases the number wheel (108) which can be driven by means of a gearwheel (114) and the wheel axle (107).

17 Claims, 5 Drawing Sheets

(56) References Cited

U.S. PATENT DOCUMENTS 5,046,378 A * 9/1991 Bannister ..... F16H 27/08 101/110
5,279,219 A * 1/1994 Hoffa ..... B41J 1/60 101/100
5,402,717 A * 4/1995 Benard ..... G07B 17/00508 101/110
5,660,106 A * 8/1997 Pitz ..... B41K 3/123 101/110
8,671,836 B2 * 3/2014 Wursch ..... B41F 13/0032 101/110

FOREIGN PATENT DOCUMENTS

EP 1 892 099 A1 2/2008
EP 2 236 295 A1 10/2010

* cited by examiner

NUMBERING MACHINE

CROSS REFERENCE TO RELATED APPLICATIONS

This application is a United States National Phase Application of International Application PCT/EP2011/006583, filed Dec. 27, 2011 and claims the benefit of priority under 35 U.S.C. §119 of German Patent Application DE 10 2011 008 859.8 filed Jan. 18, 2011, the entire contents of which are incorporated herein by reference.

FIELD OF THE INVENTION

The invention pertains to a numbering machine having a housing, with a wheel axle, which is arranged removably in the housing and on which a plurality of number wheels, adjustable each one by one, are arranged rotatably. At least one of the number wheels can be driven via a gear wheel associated with the number wheel. The numbering machine has a drive shaft for each number wheel that can be driven.

BACKGROUND OF THE INVENTION

Such numbering machines are used when continuous or randomly determined serial numbers are to be applied to a printed object, especially a document, for example, when printing blank checks, banknotes or identity papers. A typical example of such a numbering machine is the Leibinger PC LEN device, which is used, for example, in Heidelberg GTOZ-NN-52 model printing presses for printing checks. Information on these devices can be found, for example, in the prospectus "High Security Numbering" of the firm of Leibinger.

Such a numbering machine has a housing with a wheel axle, which is arranged in the housing removably for maintenance, cleaning or for replacement with another font and on which a plurality of number wheels can be arranged rotatably. It is noted that the designation "number wheel" does not represent, in the sense of this patent specification, any limitation to numbers, and the term is rather used synonymously with the designation "print wheel."

Simple removability of the wheel axle is important for making it possible to carry out the cleaning and maintenance operations necessary after the printing process.

The number wheels are each adjustable one by one and at least one number wheel can be driven by means of a gear wheel associated with the number wheel. The numbering machine has a drive shaft with a drive pinion connected to the drive shaft for each number wheel connected to a drive unit, so that rapid setting of a desired combination of fonts is guaranteed.

A plurality of numbering machines are often arranged on a shaft of a printing press in case of the usual use of such numbering machines in order to make a rapid and continuous printing process possible. The bulkier the individual numbering machines, the greater is the minimum distance between serial numbers, which can be printed with two numbering machines arranged adjacent to one another on a shaft. The more number wheels are arranged on the wheel axle, the more serious becomes the problem, because an increasing number of drive axles—and also an increasing number of motors in case of numbering machines driven by motor—must be accommodated in a given space.

This leads to the effort to make available numbering machines of the most compact design possible in order to also apply number sequences on crowded, small formats.

SUMMARY OF THE INVENTION

An object of the present invention is to make available a compact numbering machine that makes possible the simple cleaning and maintenance of the wheel axle with a set of number wheels, and that makes it possible, furthermore, to set the combination of fonts to be printed rapidly.

According to the invention, a numbering machine is provided comprising a housing a wheel axle arranged removably in the housing a plurality of number wheels arranged rotatably on the wheel axle and adjustable each one by one, a gear wheel associated with at least one of the number wheels that can be driven via the gear wheel and a drive shaft for each of the number wheels that can be driven via the associated gear wheel. A drive pinion is connected to the drive shaft. At least one drive shaft is a displaceable drive shaft transferable from an operating position, in which the number wheel driven via a gear wheel is set in rotation by the displaceable drive shaft, into a removal position, in which the displaceable drive shaft releases the number wheel, which can be driven via a gear wheel, and the wheel axle.

The numbering machine according to the present invention has a housing with a wheel axle, which is arranged removably in the housing and on which a plurality of number wheels are arranged rotatably. Simple cleaning and maintenance of these mechanical components is guaranteed due to the removability of the wheel axle with the number wheels.

The number wheels can be driven each one by one via a gear wheel associated with the number wheel, and the numbering machine has a drive shaft with a drive pinion connected to the drive shaft for each number wheel connected to a drive unit, so that rapid setting of the combination of fonts to be printed is made possible. An association of the number wheel with the gear wheel is present especially if the number wheel and the gear wheel cannot be rotated independently from one another, so that each rotation of the number wheel also entails a rotation of the gear wheel by an equal angle or a different angle (transmission).

It is essential for the present invention that at least one displaceable drive shaft is provided, which can be transferred from an operating position, in which the number wheel can be set in rotation by the displaceable drive shaft, into a removal position, in which the displaceable drive shaft releases the number wheel and the wheel axle. The provision of such a displaceable drive shaft, which may be arranged pivotably or displaceably especially relative to the wheel axle, makes it possible to arrange drive shafts in areas of the numbering machine that could not hitherto be outfitted, in order to guarantee simple and unproblematic removability of the wheel axle without the necessity to remove individual drive components from the numbering machine. This can be achieved, e.g., especially by means of a drive shaft that can be swung out or displaced.

Provisions are made in an especially advantageous embodiment of the present invention for the axes of rotation of the drive shafts to be located on a segment of a circle when the displaceable drive shafts are in the operating position. This happens because the circle segment offers an especially advantageous ratio of the area made available to the given circumference. It is especially preferred here if the center of the circle on the segment of which the axes of rotation of the drive shafts are located is located on the axis of rotation of the number wheels. If a plurality of numbering machines are arranged on one shaft, this geometric condition causes the distance between the combination of fonts just set and the axis of rotation of the shaft to be able to be reduced, which makes it possible to print on small-area objects without leading to limitations in terms of the number of drive axles that can be operated, because the arrangement of drive axles under the wheel axle remains possible.

It is especially advantageous if the circle segment covers an angle range >180°. It is especially advantageous to surround the wheel axle, which still must, however, make it possible to print the combination of fonts set, with drive axles in order to make it possible to drive a maximum number of number wheels with a minimum space requirement.

In a preferred embodiment of the present invention, the housing has a cover, and the displaceable drive shaft can be transferred into the removal position by opening the cover. In particular, displaceable drive shafts can be mounted in the cover, so that they can be removed by swinging up a cover connected rotatably to the housing or by pulling off a cover that can be separated from the housing. A machine cover may be advantageously integrated in the cover.

Provisions are made in another advantageous embodiment of the present invention for providing at least one catch for locking a number wheel, which has a section, which at least partly meshes with gaps between the teeth of the gear wheel associated with the number wheel, i.e., from the tips of the teeth of the gear wheel. This embodiment makes possible a compact design of the wheel axle and thus likewise contributes to the most compact design possible of numbering machines.

The gear wheel assumes a dual function in this embodiment: On the one hand, the transmission of the drive motion, especially via the drive pinion, and, on the other hand, accurate positioning and holding of the number wheel by the catch, especially a linearly acting catch. This dual function makes it possible to minimize the space between the individual engravings prepared on the number wheel.

It is advantageous, furthermore, to provide an electromechanical load-relieving device for the catches. This makes it possible to use less powerful and hence more compact motors for the drive. In particular, a preferred electromechanical load-relieving device may be designed such that the catches have a compression spring as a catch spring, which is mounted in a base mount, and that the base mount can be lowered by means of an eccentric shaft for the entire series, parts of the series or one by one.

It was found that it is advantageous if the section of the catch, which at least partly meshes with gaps between the teeth of the gear wheel associated with the number wheel, has a curvature with a radius that is greater than the radius of a curvature that the tips of teeth of the gear wheel associated with the number wheel have, especially greater than five times thereof, and the module of the teeth of the gear wheel is essentially about half the radius of the catch, because this embodiment represents a suitable ratio of the driving force and positioning force and makes possible an optimal wear characteristic.

A geared servomotor each is advantageously provided for driving each drive shaft in an advantageous numbering machine, and it can be harmonized with a compact design, especially if it is arranged such that the axis of rotation of the rotor of the geared servomotor coincides with the axis of rotation of the respective drive shaft. Such an embodiment is especially space-saving if the geared servomotors partly dip into the housing. Another space-saving measure, which can be taken alternatively or cumulatively thereto, is to arrange geared servomotors for different drive shafts on two opposite sides of the housing.

A numbering machine that can be actuated in an especially advantageous manner is obtained if the number of teeth on the gear wheel is an integral multiple of the number of numbers of the respective number wheels.

Another possibility of obtaining a numbering machine that can be actuated in a simple manner, which can be provided cumulatively or alternatively to the above-mentioned embodiment, is to make provisions for the total gear ratio of the drive to be integrally divisible by the number of numbers of the respective number wheels.

It is advantageous, furthermore, if an integrated electronic unit for controlling the numbering machine is arranged in the housing. It is especially advantageous if a software control with an adaptive algorithm, which monitors and adaptively adjusts parameters of the numbering machine during the operation, is provided in this case.

Exemplary embodiments of the present invention will be explained in more detail below on the basis of figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
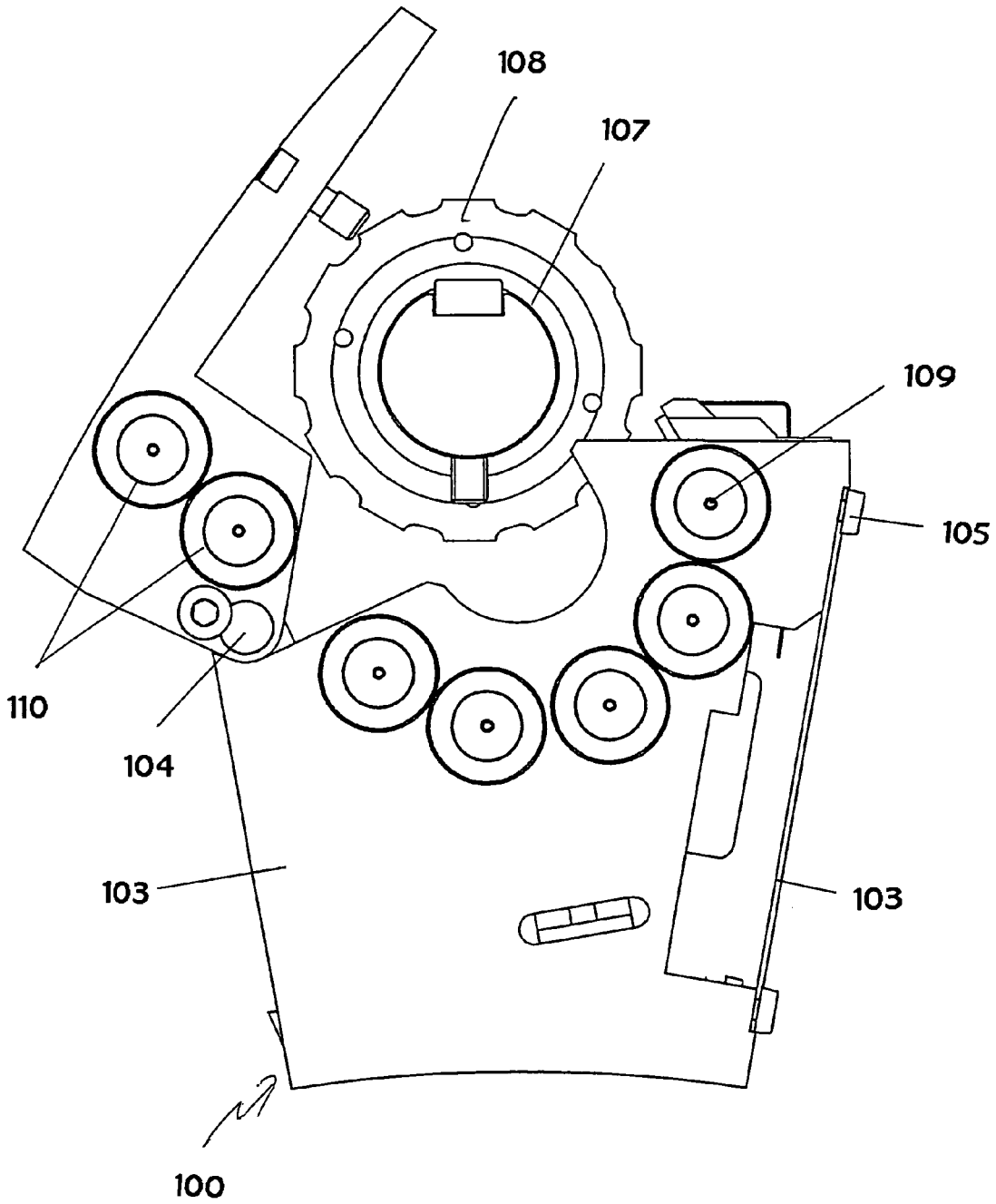
FIG. 1 is a side view of a first exemplary embodiment of a numbering machine according to the invention.

Referring to the drawings in particular, identical components of identical embodiments are designated by the same reference numbers in all figures.

FIG. 1 shows the side view of a numbering machine 100 of a first exemplary embodiment of the present invention. A housing 101 with a cover 102 and with a side plate 103 is seen. Cover 102 is connected to the housing 101 in a hinged manner by means of a hinge 104 and is shown in the swung-up position. Side plate 103 is fastened to housing 101 with screws 105.

Figure 2:
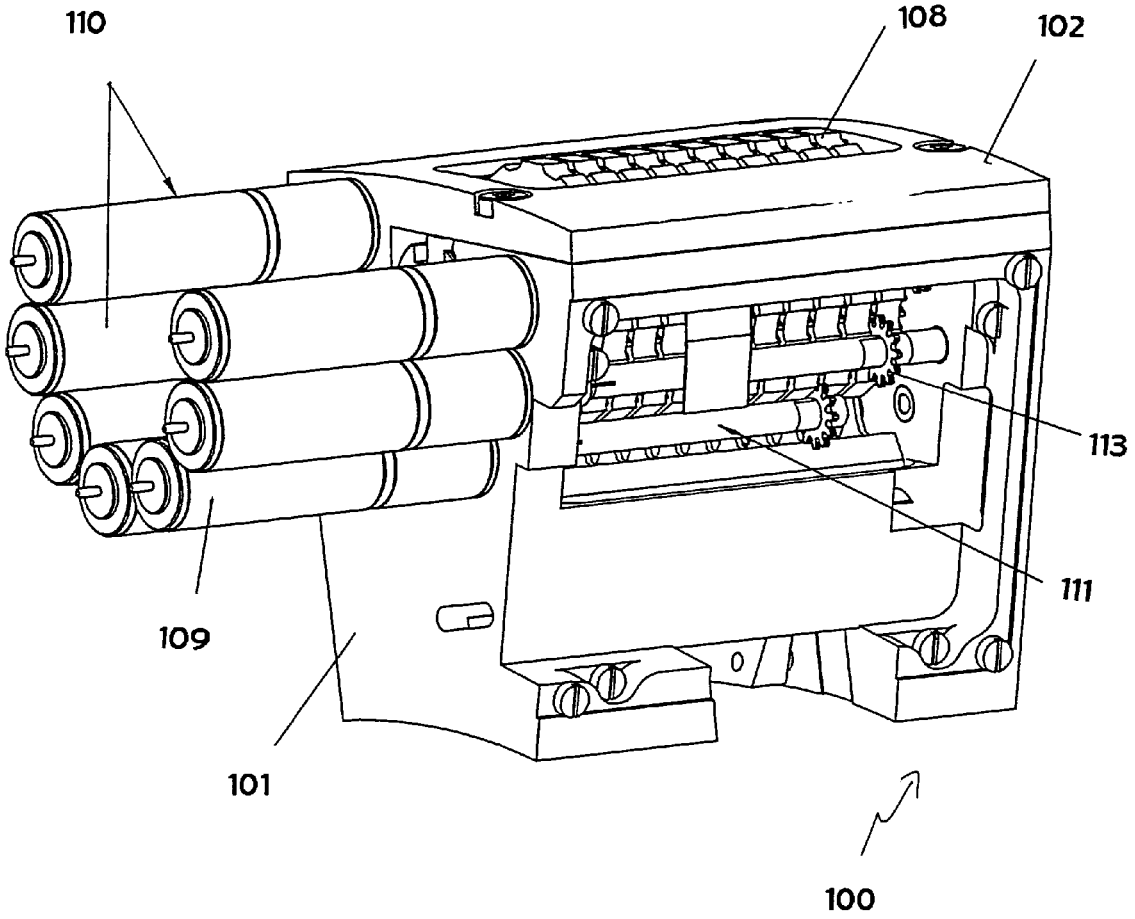
FIG. 2 is a view of the exemplary embodiment from FIG. 1 when viewed obliquely from the front with the side plate removed.

As can be seen in the view in FIG. 2, a wheel axle 107 with number wheels 108 arranged movably on it is mounted removably in a circle-segment-shaped recess 106 in housing 101. Wheel axle 107 is shown in the removed state in FIG. 1.

Five geared servomotors 109 are arranged on housing 101 on the outside, and two more geared servomotors 110 are arranged on housing cover 102. The number and distribution of the geared servomotors 109, 110 can be adapted to drive the desired number of number wheels 108. on wheel axle 107. Numbering machines according to the present invention may, in principle, also be set manually without the use of motors, which may happen both with the use of drive shafts 111, 112 and by direct manipulation with the corresponding number wheel 108, so that, in particular, the situation shown as an example in FIG. 2, in which the number of drive shafts 111, 112 present is smaller than the number of number wheels 108 on wheel axle 107, may occur.

As can be seen in the view of the numbering machine 100 in FIG. 2, the geared servomotors 109, 110 are each connected to drive shafts 111, 112, on which a pinion 113 each is arranged permanently for driving one of the number wheels 108. The arrangement is selected to be such that the axis of rotation of the rotor of the geared servomotors 109, 110, which rotor is not shown, coincides with the axis of rotation of the respective drive shafts 111, 112.

Figure 3:
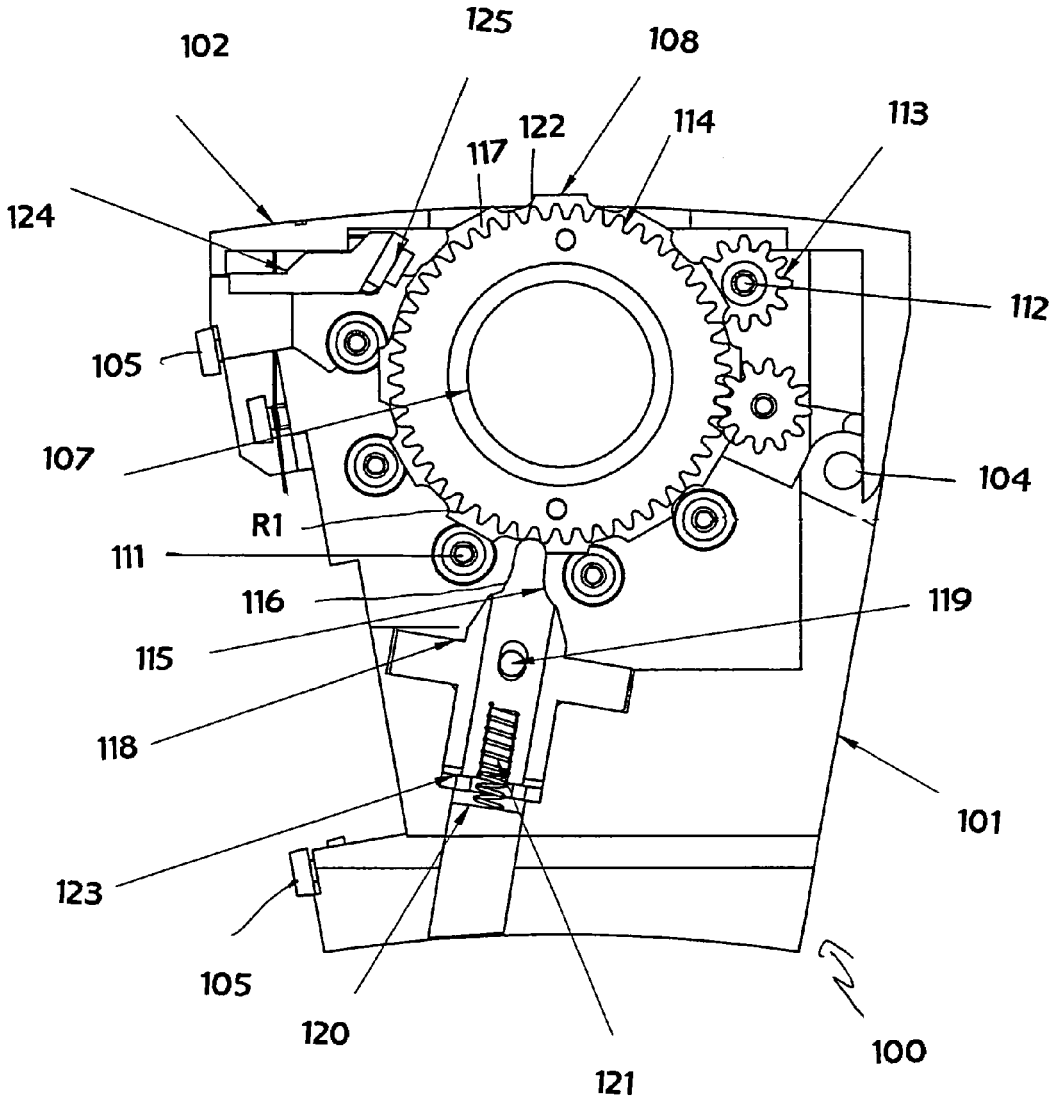
FIG. 3 is a cross sectional view through the exemplary embodiment from FIG. 2.

As it appears especially clearly from the cross-sectional view in FIG. 3, the drive shafts 112 are mounted in sections of cover 102, while the drive shafts 111 are mounted in sections of housing 101. The drive shafts 112 can thus be transferred from the operating position shown in FIGS. 2 and 3, in which the number wheel 108 can be put in rotation by the corresponding drive shaft 112, into a removal position, in which the respective drive shafts 112 release number wheel 108 and wheel axle 107, by swinging up the cover 102, which is made possible by hinge 104.

It appears, furthermore, from FIG. 3, that geared servomotors 109, 110 and the axes of rotation of the drive shafts are located on a segment of a circle, which segment is not shown, when the displaceable drive shafts 112 are in the operating position, and that the center of the circle, on the segment of which the axes of rotation of the drive shafts 111, 112 are located, is located on the axis of rotation of the number wheels 108. In particular, FIG. 3 shows clearly that the circle segment covers an angle range >180° in the operating position.

The individual number wheels 108 are driven by gear wheels 114, which are connected to them such that they rotate in unison and with which the corresponding drive pinions 113 mesh. To set a desired combination of fonts, the individual number wheels 108 can thus be moved into the desired position by the geared servomotors associated with them via the gear wheels 114, drive pinion 113 and drive shafts 111, 112.

To ensure that the number wheels 108 remain in the desired position, an optional catch 115, which has a section 116, which partly meshes from the outside with gaps 117 between the teeth of the gear wheel 114 associated with the number wheel 108, is provided in the embodiment according to FIGS. 1 through 3. Section 116 is guided in a catch guide 118, so that only a linear motion is possible even during the rotation of the gear wheel 114 and the catch 115 is prevented from yielding laterally in the direction of rotation of the gear wheel 114 and the catch is secured by a catch securing means 119. Catch 115 is pressed by a compression spring 121 supported on a support plate 120 onto the gear wheel 114 and thus counteracts the motion of the gear wheel. This compression spring 121 represents the catch spring. However, if the gear wheel 114 is being driven, catch 115 is pushed back against the spring force and permits a tooth 122 of the gear wheel 114 to slip through, unless this motion is prevented by the advancing of a stopper 123.

Section 116 of the catch 115, which meshes at least partly from the outside with gaps 117 between the teeth 122 of the gear wheel 114 associated with the number wheel 108, has a first curvature R1 with a radius that is greater than the radius of a curvature R2 that the tips of teeth 117 of the gear wheel associated with the number wheel 108 have, and it is especially greater than five times that radius, and the module of the teeth of the gear wheel 114 is essentially approximately half the radius R1 of section 116 of the catch 115. This design makes possible a suitable ratio of the driving force to the positioning force and an optimal wear characteristic.

Due to the drive shafts 112 being arranged in the hinged cover 102 and to the fact that they are displaceable as a result, it thus becomes possible to arrange drive shafts 112 in the operating state such that they prevent the wheel axle 107 from being removed, but simple removability of the wheel axle 107 is guaranteed at the same time in case of displacement into the removal position, which is reached when the cover 102 is swung up.

FIG. 3 shows, furthermore, an optional sensor holder 124 with a sensor strip 125, with which the current position of the number wheels 108 can be determined. This may be, for example, a Hall sensor, which reads the position of one or more magnets arranged in the number wheel.

Figure 4A:
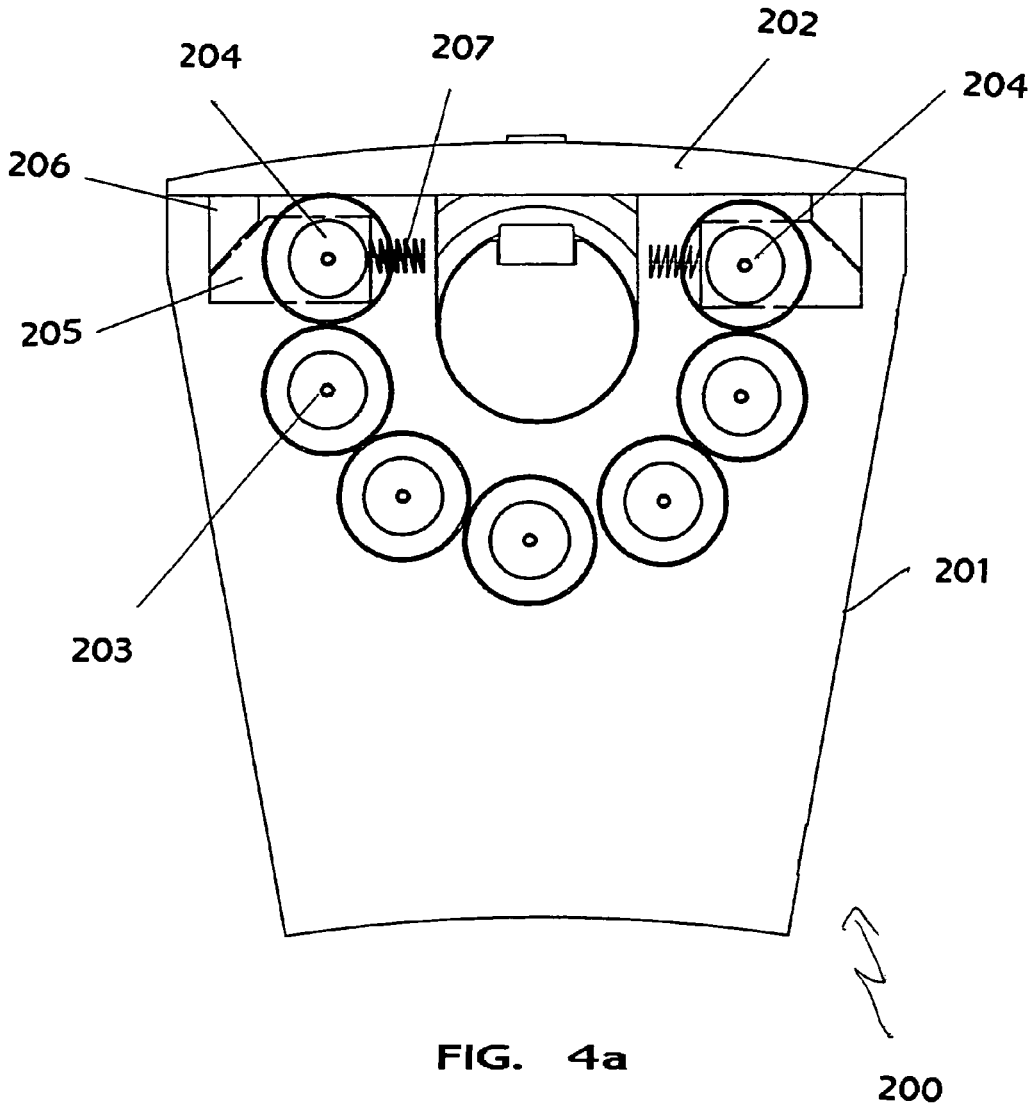
FIG. 4*a* is a cross sectional view through a second exemplary embodiment of a numbering machine according to the invention, shown in the closed state.
Figure 4B:
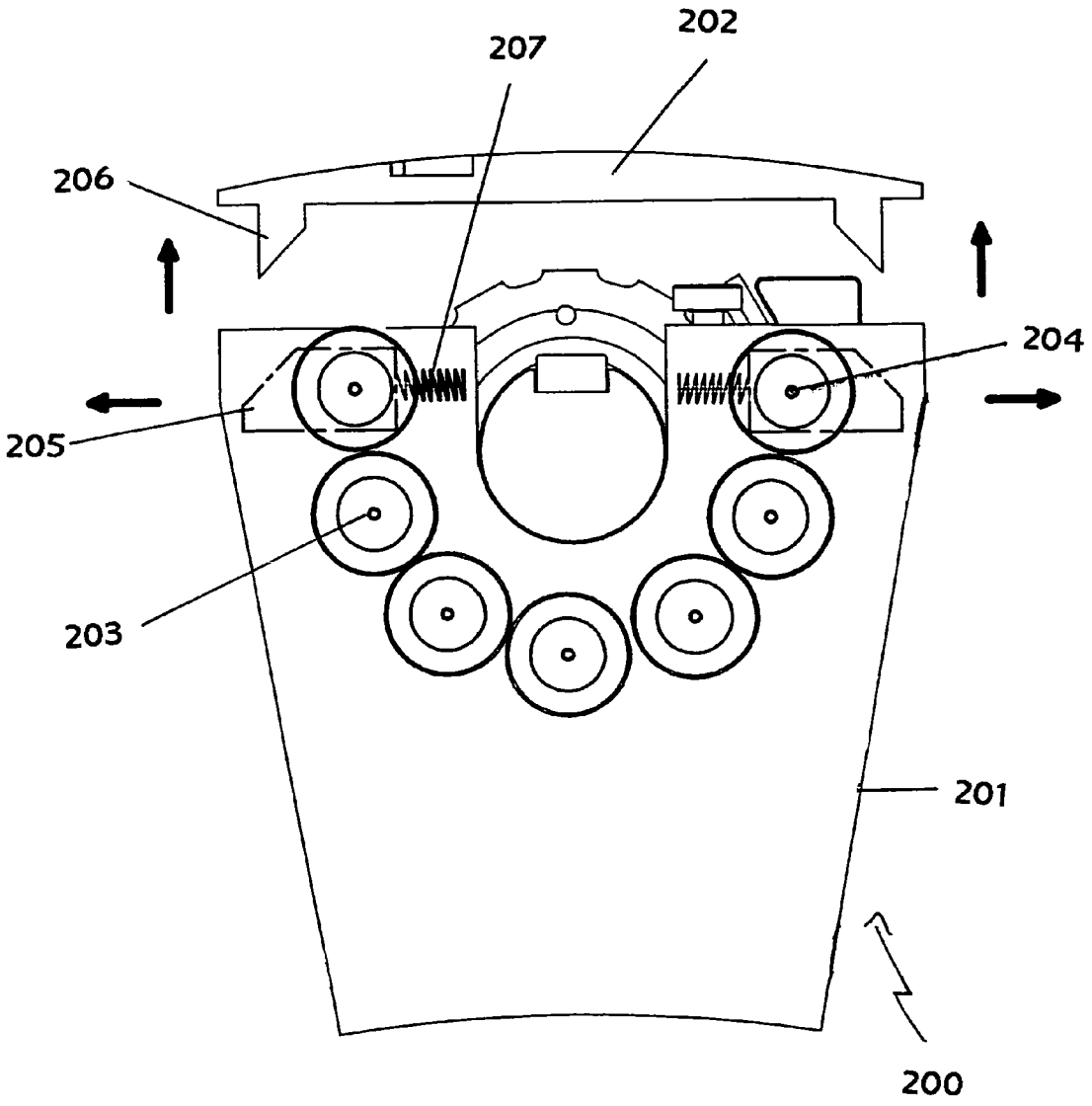
FIG. 4*b* is a cross sectional view through the exemplary embodiment of FIG. 4*a*, shown in the opened state.

The numbering machine 200 shown in FIG. 4*a* differs from numbering machine 100 only in that a housing 201 with a removable cover 202 is provided and that the geared servomotors 203, 204 and the drive shafts, which are driven by these and are not shown in FIG. 4*a*, are all mounted on housing 201. The geared servomotors 204 and the drive shafts, which are driven by them and are not shown, are displaceable in this case due to the fact that they are mounted in slots 205 in housing 201 and are pushed into the operating position against the force of compression springs 207 by wedge-shaped projections 206 provided in the cover when said cover 202 is attached. Thus, when cover 202 is removed, they are automatically displaced to the outside by the force of the compression springs 207 into the removal position, in which wheel axle 208 can be removed from housing 201. This state is shown in FIG. 4*b*, where the displacement of the geared servomotors 204 and of the drive shafts, which are driven by them and are not shown, is represented by the arrows printed in bold, which point in the lateral direction.

While specific embodiments of the invention have been shown and described in detail to illustrate the application of the principles of the invention, it will be understood that the invention may be embodied otherwise without departing from such principles.

The invention claimed is:

1. A numbering machine comprising:

a housing;

a wheel axle arranged removably in the housing;

a plurality of number wheels arranged rotatably on the wheel axle and adjustable each one by one;

a gear wheel associated with at least one of the number wheels that is driven via the gear wheel; and a drive shaft for each of the number wheels that is driven via the associated gear wheel and a drive pinion connected to the drive shaft, wherein at least one drive shaft is a displaceable drive shaft transferable from an operating position, in which the number wheel driven via a gear wheel is set in rotation by the displaceable drive shaft, into a removal position, in which the displaceable drive shaft releases the number wheel, which is driven via a gear wheel, and the wheel axle, the axes of rotation of the drive shafts being located on a segment of a circle when the displaceable drive shafts are in the operating position, wherein the circle segment covers an angle range greater than 180°.

2. A numbering machine in accordance with claim 1, wherein the center of the circle on the segment, of which the axes of rotation of the drive shafts are located, is on the axis of rotation of the number wheels.

3. A numbering machine in accordance with claim 1, wherein the housing has a cover and the displaceable drive shaft is transferred into the removal position by opening the cover.

4. A numbering machine in accordance with claim 3, wherein the displaceable drive shaft is mounted in the cover.

5. A numbering machine in accordance with claim 3, wherein a machine cover is integrated in the cover.

6. A numbering machine in accordance with claim 1, further comprising: a catch, which has a section that meshes with gaps between teeth of the gear wheel associated with the number wheel at least partly from the outside, is provided for locking a number wheel.

7. A numbering machine in accordance with claim 1, wherein the catches comprises a compression spring as a catch spring, which is mounted in a base mount, and the base mount is lowered via an eccentric shaft for the entire row, parts of the row or one by one.

8. A numbering machine in accordance with claim 6, wherein a section of the catch, which meshes with gaps between the teeth of the gear wheel associated with the number wheel at least partly from the outside, has a first curvature with a radius that is greater than the radius of a curvature that the tips of teeth of the gear wheel associated with the number wheel have, and the first curvature is greater than five times thereof, and the module of the teeth of gear wheel is essentially about half the radius of the section of the catch.

9. A numbering machine in accordance with claim 1, further comprising a geared servomotor arranged such that an axis of rotation of the rotor of the geared servomotor coincides with an axis of rotation of the respective drive shaft, is provided for driving each drive shaft.

10. A numbering machine in accordance with claim 9, wherein the geared servomotors partly extend into housing.

11. A numbering machine in accordance with claim 9, wherein the geared servomotors are arranged for different drive shafts on two opposite sides of the housing.

12. A numbering machine in accordance claim 1, wherein the number of teeth on gear wheel is an integral multiple of the number of numbers of the respective number wheels.

13. A numbering machine in accordance with claim 1, wherein the total gear ratio of the drives is integrally divisible by the number of numbers of the respective number wheels.

14. A numbering machine in accordance with claim 1, further comprising a software control with an adaptive algorithm, which monitors and adaptively adjusts parameters of the numbering machine during the operation.

15. A numbering machine comprising:

a housing;

a wheel axle removably supported in the housing;

a plurality of number wheels arranged rotatably on the wheel axle, each number wheel being adjustable as to rotational position, at least some of the plurality of number wheels being driven number wheels;

a plurality of gear wheels respectively associated with the driven number wheels; and a plurality of drive shafts respectively associated with the driven number wheels and with a drive pinion respectively connected to the drive shafts wherein at least one of the drive shafts is a displaceable drive shaft movable from an operating position, in which the number wheel is driven via the gear wheel is set in rotation by the displaceable drive shaft, into a removal position, in which the displaceable drive shaft releases the number wheel, the axes of rotation of the drive shafts being located on a segment of a circle when the displaceable drive shafts are in the operating position, the circle segment covering an angle range greater than 180°.

16. A numbering machine comprising:

a housing;

a wheel axle arranged removably in the housing;

a plurality of number wheels arranged rotatably on the wheel axle and adjustable each one by one;

a gear wheel associated with at least one of the number wheels that is driven via the gear wheel; and a drive shaft for each of the number wheels that is driven via the associated gear wheel and a drive pinion connected to the drive shaft, wherein at least one drive shaft is a displaceable drive shaft transferable from an operating position, in which the number wheel driven via a gear wheel is set in rotation by the displaceable drive shaft, into a removal position, in which the displaceable drive shaft releases the number wheel, which is driven via a gear wheel, and the wheel axle, the housing having a cover and the displaceable drive shaft being transferred into the removal position by opening the cover, the displaceable drive shaft being mounted in the cover.

17. A numbering machine comprising:

a housing;

a wheel axle arranged removably in the housing;

a plurality of number wheels arranged rotatably on the wheel axle and adjustable each one by one;

a gear wheel associated with at least one of the number wheels that is driven via the gear wheel;

a drive shaft for each of the number wheels that is driven via the associated gear wheel and a drive pinion connected to the drive shaft, wherein at least one drive shaft is a displaceable drive shaft transferable from an operating position, in which the number wheel driven via a gear wheel is set in rotation by the displaceable drive shaft, into a removal position, in which the displaceable drive shaft releases the number wheel, which is driven via a gear wheel, and the wheel axle; and a geared servomotor arranged such that an axis of rotation of the rotor of the geared servomotor coincides with an axis of rotation of the respective drive shaft, is provided for driving each drive shaft, the geared servomotors being arranged for different drive shafts on two opposite sides of the housing.

* * * * *